US008631752B2

(12) United States Patent
Hauersperger

(10) Patent No.: US 8,631,752 B2
(45) Date of Patent: Jan. 21, 2014

(54) TENDER STOWAGE METHOD AND APPARATUS

(76) Inventor: Dean A. Hauersperger, Troy, MI (US)

( * ) Notice: Subject to any disclaimer, the term of this patent is extended or adjusted under 35 U.S.C. 154(b) by 109 days.

(21) Appl. No.: 12/951,346

(22) Filed: Nov. 22, 2010

(65) Prior Publication Data

US 2012/0125253 A1 May 24, 2012

(51) Int. Cl.
*B63B 27/00* (2006.01)

(52) U.S. Cl.
USPC ..... 114/259; 114/366

(58) Field of Classification Search
USPC ..... 114/259, 258, 365, 366
See application file for complete search history.

(56) References Cited

U.S. PATENT DOCUMENTS

| | | | | |
|---|---|---|---|---|
| 2,294,864 | A | 9/1942 | Palmer | |
| 3,143,991 | A | 8/1964 | Anderson | |
| 4,157,596 | A | 6/1979 | Green | |
| 4,850,295 | A | 7/1989 | Weaver | |
| 4,964,358 | A | 10/1990 | Sandrow | |
| 5,018,473 | A | 5/1991 | Foster | |
| 5,133,275 | A | 7/1992 | Maurizio | |
| 5,170,742 | A | 12/1992 | Roskelley | |
| 5,193,479 | A * | 3/1993 | Bielefeld | 114/366 |
| 6,038,994 | A | 3/2000 | Ford et al. | |
| 6,782,841 | B2 | 8/2004 | Esposito | |
| 7,231,882 | B2 | 6/2007 | Zander | |
| 7,475,649 | B2 | 1/2009 | Shepherd | |

* cited by examiner

*Primary Examiner* — Edwin Swinehart
(74) *Attorney, Agent, or Firm* — Bejin VanOphem & Bieneman PLC

(57) ABSTRACT

The present invention provides a singlehanded means, by the use of a lift arm mechanism, to lift a small yacht tender or dinghy from the water and stow and retrieve the tender or dinghy from the roof (or suitable support structure) above the yacht's cockpit. The lift arm mechanism includes a pair of lift arm members which are connected with a pivotable connection between the stern of the host vessel and the transom of the tender. Pivot connections permit upward and downward pivoting of the lift arm members with respect to the stern of the host vessel as well as permit pivoting upward and downward of the tender relative to the lift arm members. The mechanism permits the outboard motor of the tender to be easily removed and allows full use of the swim platform when the tender is in the stowed position.

10 Claims, 4 Drawing Sheets

TENDER STOWAGE METHOD AND APPARATUS

CROSS-REFERENCE TO RELATED APPLICATIONS

Not applicable.

STATEMENT REGARDING FEDERALLY SPONSORED RESEARCH

Not applicable.

REFERENCE TO SEQUENCE LISTING

Not applicable.

BACKGROUND OF THE INVENTION

1. Field of the Invention

The invention relates generally to a lift and storage device for a small boat tender, inflatable or rigid, and more particularly to a singlehanded means to stow and retrieve a small yacht tender on the roof or over the stern section of a larger host vessel.

2. Description of Related Art

In the operation of a sailboat or a power boat, many marine venues require that the boat be anchored offshore and as a result, a small boat such as a dinghy or personal watercraft is needed to transfer persons and/or supplies between shore and the anchored host vessel. Therefore, it is not uncommon to see such larger vessels with a dinghy in tow, attached by a tow line to the stern of the larger host vessel.

Handling of the dinghy, particularly when the boat is in motion, has posed problems. Towing of a dinghy with a tow line which is secured to the dinghy at a single point, results in a significant drag on the boat which greatly affects the operation of the host vessel. Further, water currents or turbulence can interfere with the safe raising and storage of the dinghy, particularly in rough seas. Problems arise if the dinghy motor is not removed during such towing. There is a serious risk that the dinghy motor will be flooded with water if the dinghy submerges with the wave action in rough waters.

Removal of the motor leads to other problems. The dinghy tends to drift uncontrollably because of its relative light weight construction. This drifting problem becomes relatively acute in narrow waterways where other vessels as well as adjacent permanent structures such as boat docks, swimming docks, launching ramps, etc. may be present. Further, in such narrow waterways the speed of the host vessel is reduced which significantly increases the drifting problem.

Since the dinghy is used to transfer persons to and from shore, it is necessary to first install the outboard motor on the dinghy before it can be used. Such installations pose additional problems since most dinghies are not particularly stable and minor changes in weight distribution can easily shift and tilt the dinghy dramatically. Installing an outboard motor on the dinghy in open waters can easily result in loss of the outboard motor as well as in personal injury. As a result, many boat operators choose to simply tow the dinghy with the outboard motor installed and accept the risk of possible water damage over the potential difficulties and safety aspects associated with outboard motor removal and installation.

The prior art has attempted to solve some of the stated problems. For example, Anderson, U.S. Pat. No. 3,143,991 describes a device for carrying a dinghy on a transom shelf of a step providing a shelf area extending rearwardly of the stern and slightly above the waterline of the host vessel. The device is a bi-articulated linkage mechanism attached to the transom of a power cruiser. The bi-articulated frame is hoisted until the frame has pivoted upwardly sufficient to lift the inboard side of the dinghy out of the water and support most of the dinghy's weight thereon, yet leave the outboard side of the dinghy at least partially in the water. At this point, inboard portions of the frame have moved into abutting relation with the inboard side of the dinghy.

The dinghy is then hoisted clear of the water by hauling in on an outboard line attached to the outboard side of the dinghy. During this sequence, the dinghy laterally tilts toward the cruiser moving about a pivot axis provided by pivot pins on the linkage. As the dinghy is lifted by the outboard line, the bi-articulated linkage becomes fully folded on the shelf and with the weight of the dinghy progressively aiding the tilting and linkage folding movement. Upon completion of the tilting movement, the dinghy nests against the stern edge of the cruiser substantially directly above the gunwale. A line is secured to a suitable cleat on the cruiser to maintain this dinghy until the dinghy is launched for use.

Sandrow, U.S. Pat. No. 4,964,358 describes a dinghy rigging mechanism designed to permit the expeditious recovery, hoisting and stowing of a small boat or dinghy in an upright position at the stern of a host vessel. The invention is devised to be readily detached from the host vessel and stowed to avoid unsightly presence of the equipment when it is not being used.

The rigger equipment may be detachably affixed for use directly on the transom of a host vessel or adapted to be detachably secured at the trailing edge of a swim platform. The mechanism is devised to dip into the water, allowing the small boat or dinghy to be floated into position on the arms of the rigging apparatus. Since the dinghy is recovered while being maintained upright, the outboard motor or steering equipment need not be removed from the dinghy in order to recover and stow the small craft on the host vessel.

Burke, U.S. Pat. No. 5,018,475 describes a bracket for securing a dinghy to a yacht. The bracket has a member adapted to fit over one of the pontoon portions of the dinghy. The bracket has, at one end thereof, an element for removably securing the member to the yacht. The bracket also comprises a mounting assembly for mounting the member to the dinghy.

Maurizio, U.S. Pat. No. 5,133,275 describes the onboard dinghy cradle which comprises a framework of hollow tubings that are secured together by fittings and connectors. The framework produced includes bottom cross members which extend across the width of the dinghy at a predetermined distance below the bottom surface thereof. Side tubings are also provided for positioning one side of the dinghy close to a supporting surface for the cradle, such as a swim platform, and to keep the dinghy from moving away as it is being boarded or left. The cradle is pivotally mounted to the supporting structure so it can be pivoted to a vertical storage position, having the dinghy, with or without a small outboard motor attached thereto, up and out of the water.

Weaver, U.S. Pat. No. 4,850,295 describes a davit for an inflatable dinghy or other small inflatable boat including a pair of lock devices secured to the stern of the carrier host boat for engaging and supporting a hanger assembly mounted on the inflatable dinghy and enabling the dinghy, to be swung between in-water and out-of-water positions, and a pair of stand-off brackets attached to the stern of the carrier host boat that support the inflatable dinghy in its raised out-of water position. Each hanger assembly has an outboard catch supported by a resilient, flexible pad which in turn is adhesively secured to the dinghy sidewall or causing the support pad to separate therefrom.

These and other prior art teach various hoist and dinghy systems in an effort to solve some of the aforementioned problems. However, what is needed is a singlehanded means to stow and retrieve a dinghy or small yacht tender and yet provide unencumbered access to swim platforms in the stowed or deployed positions, and provides a very stable platform for loading an outboard motor installation or removal via a latching system.

SUMMARY OF THE INVENTION

The present invention enables single-handed, simple and rapid launching, recovery and stowage of a dinghy or small yacht tender on the roof or comparable suitable upright support structure mounted to the deck of a host vessel or above the host vessel's cockpit. The invention provides a host vessel and dinghy or small yacht tender with a lift arm frame mechanism, mounted to the stern of the host vessel, coupling the tender to the host vessel to stabilize the tender with respect to the host vessel. Under these conditions, the tender can be comfortably loaded or unloaded and the tender is reasonably close to the step or swim platform shelf extending rearwardly from the vessel that permits easy, safe removal or mounting of the dinghy's outboard motor.

The frame mechanism is an H-shaped lift arm mechanism with two longitudinal lift arm members attaching the transom of the tender with the transom of the host vessel. A cross member is positioned nearer to the tender end. With the outboard motor positioned between the tender and the swim platform of the host vessel, the removal or installation of the outboard motor from the tender is considerably simplified and safer than the prior art method of removing an outboard motor from a tender or dinghy. Also, the H configuration of the frame mechanism holds the tender in a very stable fashion relative to the host vessel.

The rooftop configuration of the host vessel for storing the tender can be either of two configurations. If the host vessel's rooftop extends completely over the stern of the host vessel, the tender can be partially or completely stored on the roof. If the host vessel's rooftop does not extend over the stern portion of the vessel, a support frame made from marine tubing, can easily be created or constructed over the stern portion or cockpit of the host vessel if the roof does not extend beyond the cockpit of the host vessel. In either case, an electric winch assembly is mounted on top of the roof and positioned very close to the parked location of the tender's bow when completely stored on the roof. At the rear edge of the roof, or support frame, three free-wheeling rollers are installed to assist in guiding the tender during stowage and retrieval maneuvering.

A winch cable spans from the roof mounted winch over the center pulley or roller mounted to the edge of the roof and is attached to a harness that in turn is attached to the bow of the tender as will hereinafter be disclosed. Two additional lift lines of the harness have one end attached to the winch cable nearby where the bow of the tender is attached. The opposite ends of each line are attached, respectively, to each longitudinal lift arm member of the H-shaped lift arm structure.

With the tender securely coupled to the H-shaped lift arm structure and the winch cable secured to the bow of the tender as well as to the H-shaped lift arm structure by the two lift ropes of the harness, the winch can now be energized in the up direction. The winch cable will lift the bow of the tender out of the water as the tender pivots about the pivot connection coupling mechanism mounted on the transom of the tender. The tender continues its pivoting motion until the tender comes into contact with two of the three free-wheeling rollers mounted at the edge of the rooftop (or support frame). The two rollers on either side of the center roller/pulley will support the sides of the tender (tubes in the case of an inflatable tender, gunnel in the case of a rigid tender) as the sides proceed past the rollers during stowage and deployment. As the winch cable continues in the up direction, the tender will be pulled atop the roof while the two lift ropes of the harness will lift the H-shaped lift arms to pivot the lift arms in a clockwise direction about its pivotable attachment point on the transom of the host vessel to store the tender on the roof or support frame adapted to stow the tender above an open deck at the stern of the host vessel.

A primary objective of the present invention is to provide a practical, efficient, simple, and easy way to operate the support and rigging apparatus for raising and lowering a small watercraft such as a dinghy or personal watercraft to a host vessel afloat in the water and store such dinghy on the extended roof of the host vessel or a support frame mounted above the deck or cockpit at the stern of a host vessel.

A further object of the present invention is to provide an apparatus for stowing and/or launching a personal water craft, such as a dinghy, to a host vessel wherein the person watercraft is stabilized and securely latched to the host vessel so its contents and passengers can easily and safely be unloaded onto the host vessel before the personal watercraft is hoisted for storage on the host vessel.

It is yet a further object of the present invention to provide an apparatus for stowing and/or launching a personal watercraft from a host vessel which does not encumber access to the swim platform whether the personal watercraft is in the stowed or deployed position, thus leaving the aft portion of the host vessel and swim step available for other use.

It is still a further object of the present invention to provide an apparatus for stowing and/or launching a personal watercraft from a host vessel that does not scratch, mar, or damage the personal watercraft or swim platform of the host vessel during retrieval or launching of the personal watercraft from the host vessel.

It is still a further object of the present invention to provide an apparatus for stowing and/or launching a person watercraft from a host vessel that is simple and easy to operate that only needs a single motor and winch to complete either the stowage or launching of the personal watercraft onto the host vessel.

These and other features of the present invention will become apparent from the following more detailed description, taken in conjunction with the accompanying drawings which illustrate by way of example, the principles of the invention.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENT

Figure 1:
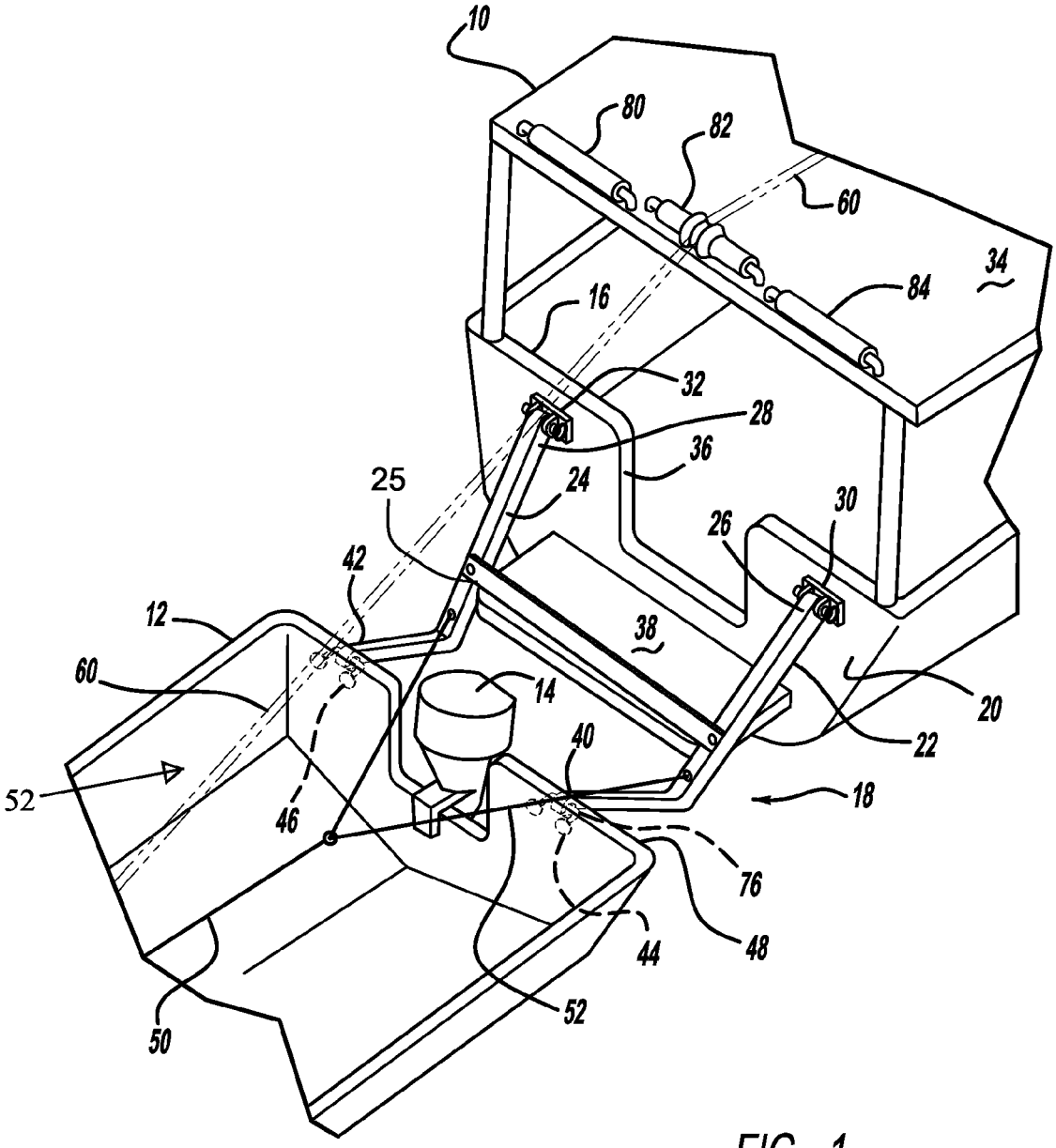
FIG. 1 is a fragmented perspective view illustrating a small yacht tender secured to a larger host vessel with a H-frame lift arm mechanism showing the invention.

With reference to the drawings, FIGS. 1-7 illustrate a single-handed means to stow and retrieve a personal watercraft, i.e. small yacht tender or dinghy 12 on the roof 34 or stern 20 section of a larger host vessel 10. As illustrated in FIGS. 1-7, if the larger host vessel 10 has a roof 34 extending from the cockpit to the stern end of the host vessel 10, the small yacht tender 12 may be partially or completely stored on the roof 34 during non-use thereof. If the host vessel 10 has no roof extending beyond the cockpit over the stern of the host vessel 10, a simple suitable support structure made from marine tubing over the cockpit can easily be constructed to provide stowage for the small yacht tender above the cockpit or stern deck of the host vessel 10.

With reference to FIGS. 1-7, there is shown a host vessel 10, i.e. a powerboat with roof structure 34 extended to cover the aft deck of the host vessel 10, as well as a small yacht tender 12 with an outboard motor 14 attached to its transom 16, and an H-frame lift arm mechanism 18 attaching the tender's transom 48 to the stern 20 of the host vessel 10.

In general terms, the lift arm mechanism 18 consists of a pair of elongated H-shaped rigid lift arm members 22, 24 of appropriate length (the length will vary as a function of the size of the small yacht tender 12 and the size of the swim platform 38 of the host vessel 10) having a first pair of ends 26, 28 coupled to pivotable connections 30, 32 for rotation thereabout as the tender 12 is lifted to its stowage place on the roof 34 of the host vessel 10. A cross member 25 is positioned near the small yacht tender 12 end to secure the elongated H-shaped rigid lift arm members 22, 24 together into a frame unit. The pivot connections 30, 32 are in a horizontally spaced-apart relationship straddling the opening 36 in the stern 20 of the host vessel 10 which permits access to the swim platform 38. The pivot connections 30, 32 permit the lift arm mechanism 18 to be pivoted upwardly and downwardly relative to the stern 20 of the host vessel 10. The opposing ends 40, 42 of the elongated H-shaped rigid lift arm members 22, 24 are releasably joined to a second pair of pivot connections 44, 46 mounted to the transom 48 of the small yacht tender 12 also in a horizontally spaced-apart relationship, straddling the attachment point of the tender's 12 outboard motor 14. Similar to the pivot connections 44, 46 mounted to the stern 20 of the host vessel 10, the pivot connections 30, 32 mounted to the tender 12 allows the tender 12 to pivot upwardly and downwardly relative to the elongated H-shaped rigid lift arm members 22, 24 and are releasable to allow deployment of the small yacht tender 12.

Figure 2:
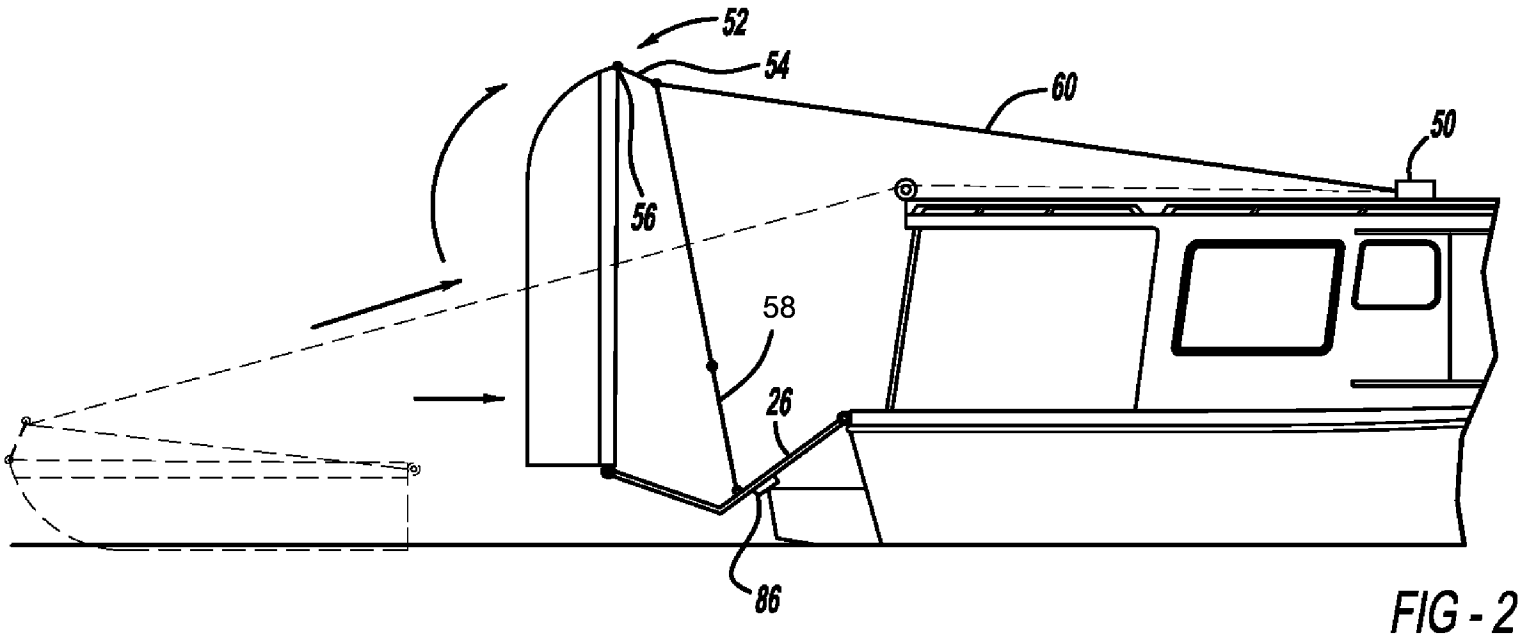
FIG. 2 is a partial side view of the small yacht tender partially raised by the winch mounted to the roof of the cockpit of the host vessel.

As clearly shown in FIG. 2, the power to lift the tender 12 out of the water and pivot about the pivot connections 30, 32 mounted to the transom 48 of the tender 12 is provided by a 12 volt battery (24 volt optional) by the use of a wireless handheld remote controlled, electric winch 50 mounted to the roof above the cockpit of the host vessel 10. A lift harness 52 has one end 54 attached to an eyebolt arrangement 56 secured to the bow 68 of the tender 12 and a bifurcated opposite end secured to each elongated H-shaped rigid lift arm members 22, 24 of the H-frame lift arm mechanism 18. The point of attachment on each elongated H-shaped rigid lift arm member 22, 24 is a function of the size of the H-frame lift arm mechanism 18 as well as the weight of the tender 12. As stated hereinabove, the size or length of the elongated H-shaped rigid lift arm members 22, 24 will vary as a function of the size and weight of the small yacht tender 12 as well as the size of the swim platform 38 on the host vessel 10. Accordingly, the attachment of the winch cable 60 to the lift harness 52 as well as the bifurcated opposite end 58 attachment to the elongated H-shaped rigid lift arm members 22, 24 will be determined at assembly of the H-frame lift arm mechanism 18 to respective first 30, 32 and second 44, 46 pivot connections between the small yacht tender 12 and the host vessel. 10. The proposed electric winch with remote control is a Ramsey Patriot UT9500 handheld remote control available from various online sources.

Figure 7:
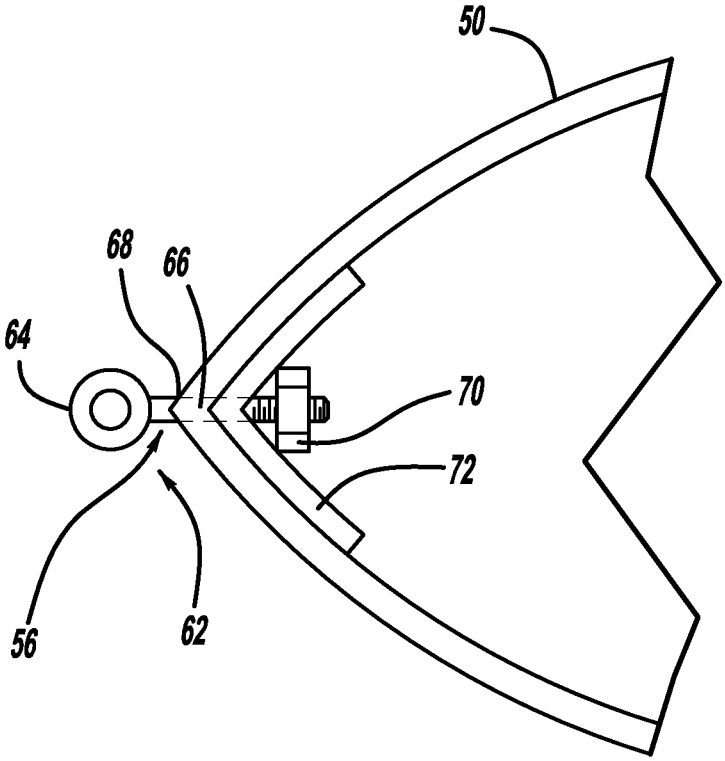
FIG. 7 is a detailed top view of the bow of the tender and the eyebolt arrangement to which the hook of the lift harness is attached.

By way of example, FIG. 7 provides greater detail regarding the construction and connection of the lift harness 52 and electric winch cable 60 to the bow 68 of the tender 12. As shown in FIG. 7, the eyebolt arrangement or clevis 56 is removably attached to the bow 68 of the small yacht tender 12. The handling apparatus 62 consists of an eyebolt 64 installed through a hole 66 which is bored into the bow 68 of the tender 12. The eyebolt 64 is secured in position by a nut 70 and reinforcing plate 72. A releasable hook attached to the forward end of the winch cable 60 is attached by sliding the hook into the eye of the eyebolt 64 and moving an associated link on the hook to the closed position as is well known in the art. The hook assembly includes a link to permit the hooking and inhibit unhooking when the hook is in the closed position. Other equivalent means of connecting the winch hook to the bow 68 of the small yacht tender 12 are also contemplated within the scope of the invention.

Figure 5A:
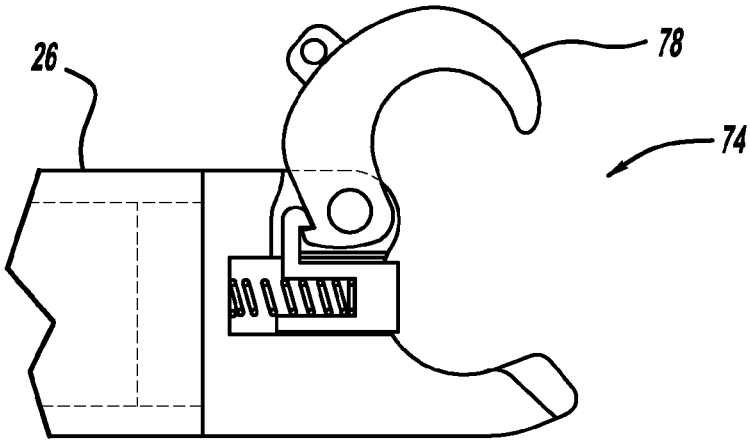
FIG. 5*a* is a side view of the hook and removable latch used for the pivot connection on top of the transom of the small yacht tender.
Figure 5B:
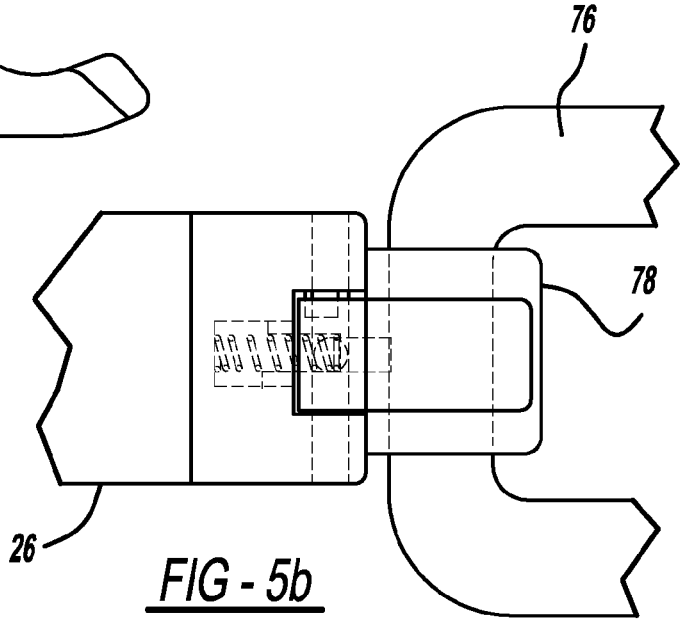
FIG. 5*b* is a fragmented top view of the removable latch used for the pivot connection on top of the transom of the small yacht tender.

The second pivot connection 44, 46 between the opposing ends 40, 42 of the elongated H-shaped rigid lift arm members 22, 24 and the transom 48 of the small yacht tender 12 is shown in FIGS. 5*a* and 5*b*. FIGS. 5*a* and 5*b* illustrate that the opposite ends 40, 42 of the elongated H-shaped rigid lift arms 22, 24 are provided with a quick release latch mechanism 74 that latches to a hinge bar 76 attached to the transom 48 of the tender 12. The quick release latch mechanism 74 has a pivot portion 78 that moves between a latched and unlatched position so that the elongated H-shaped rigid lift arm members 22, 24 can be latched to the respective hinge bar 76 mounted in a horizontally spaced apart relationship on the transom 48 of the small yacht tender 12. When the tender is to be stowed on the roof of the host vessel 10, the quick release latch mechanism 74 is attached to the respective hinge bars 76 and after unloading the passengers and outboard motor 14 from the tender 12, the stowage procedure is ready to begin.

Figure 6:
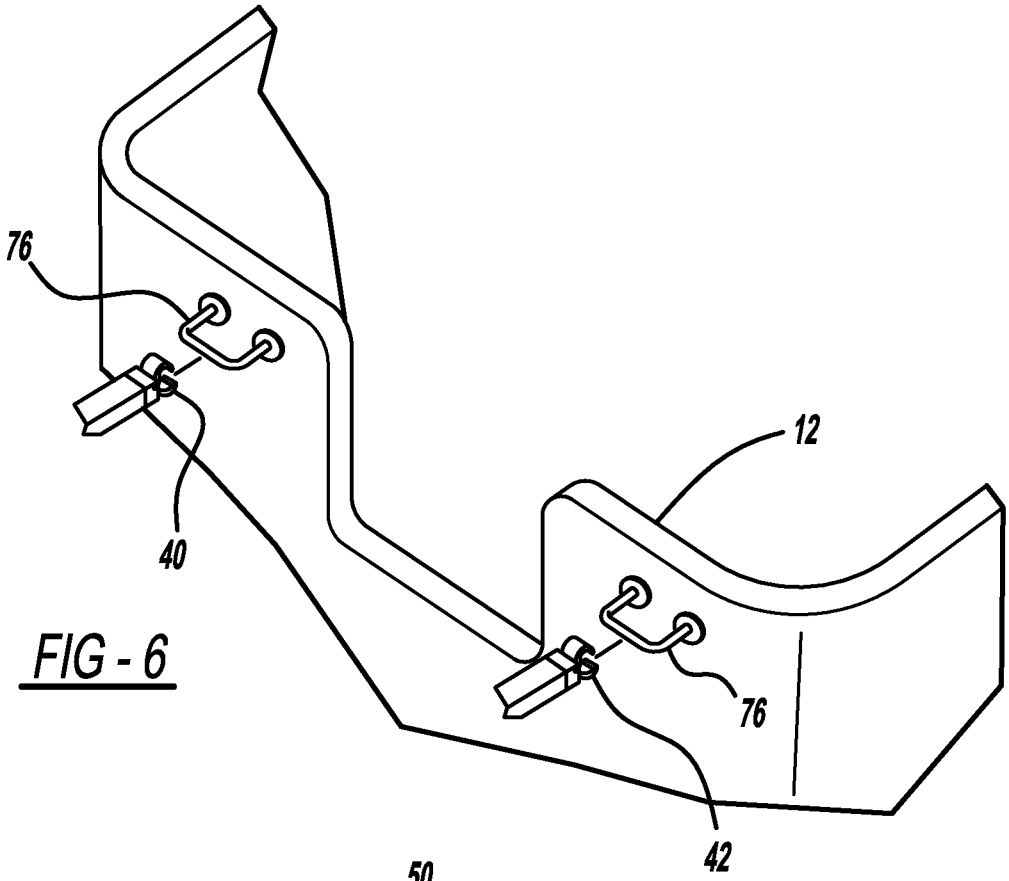
FIG. 6 is a partial perspective view of the releasable pivot hinge on the transom of the small yacht tender.

The pivot connection 30, 32 between the stern 20 of the host vessel 10 and the first pair of ends 26, 28 of the elongated H-shaped rigid lift arm members 22, 24 may use the same type of quick release latch mechanism 74 as that used on the transom 48 of the tender 12 as illustrated in FIG. 6. However, since the H-frame lift arm mechanism 18 is not intended to be removed frequently from the transom 16 of the host vessel 10, a similar hinge bar mounted to the transom 16 with a simple pivot connection retained with a hinge pin would adequately allow the H-frame lift arm mechanism 18 to pivot about the hinge bar when the small yacht tender 12 is stowed or launched from the roof of the host vessel 10. The H-frame lift arm mechanism 18 would easily be removable from the stern 20 of the host vessel 10 by simply removing the hinge pin from the pivot connection and removing the elongated H-shaped rigid lift arm members 22, 24 from the hinge bar mounted to the transom 16 of the host vessel 10.

Figure 3:
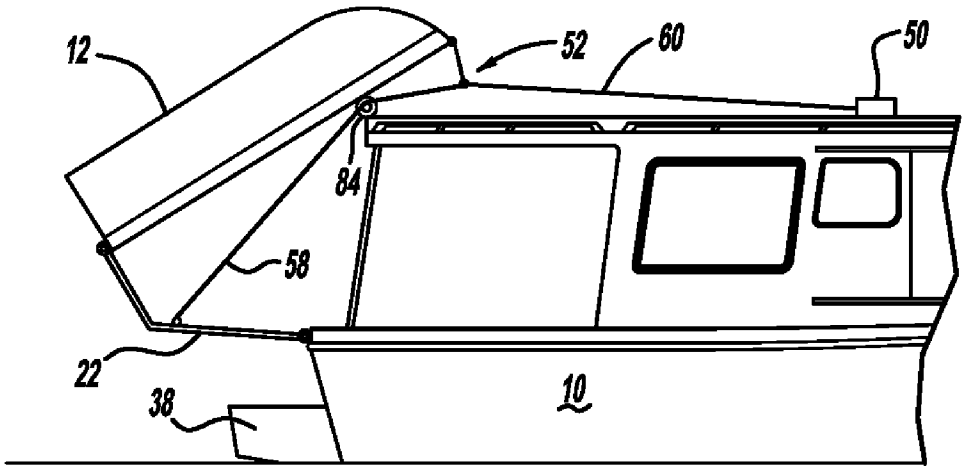
FIG. 3 is a partial side view of the small yacht tender raised onto the rollers mounted to the stern edge of the roof of the host vessel or the alternative support structure over the cockpit of the host vessel.

The operation procedure for retrieval and stowage of the small yacht tender 12 on the host vessel 10 is a single-handed operation initiated by an operator located in the cockpit since some aspects of the stowage as well as launching require manual intervention. The small yacht tender 12 is brought to the host vessel 10 in a stern 20 to stern 49 relationship as shown in FIG. 1. The opposite ends 40, 42 of each of the lift arm members 22, 24 are latched 74 to the hinge bar 76 to capture the tender 12 securely to the host vessel 10. All passengers of the tender 12 disembark by stepping onto the swim platform 38 and onto the deck of the host vessel 10. All loose gear within the tender 12 is removed and placed on the deck of the host vessel 10. The lift harness 52 is attached to the eyebolt 56 attached to the bow 68 of the tender 12 as well as to each elongated H-shaped rigid lift arm member 22, 24 of the H-frame lift arm mechanism 18. Lastly, the winch cable 60 is released and connected to the lift harness 52 or the bow 68 of the small yacht tender 12. The electric winch 50 is then energized by the operator using the wireless remote control, in the up direction. The electric winch 50 is paused as the tender 12 passes through the vertical position as shown in FIG. 2 so there is no impact at the end of rotation as the tender 12 comes to rest on the rollers 80, 84 located along the edge of the roof 34 of the host vessel 10. The center roller 82 serves as a pulley for the winch cable 60 as well as provides support for the bow 68 of the tender 12 as it crosses the center roller 82 when the electric winch 50 is reenergized to proceed with the stowage operation. The rollers 80, 84 support the sides (tubes in the case of an inflatable tender and gunnels in the case of a rigid tender 12) as shown in FIG. 3. As the electric winch 50 lifts the tender 12 over the rollers 80, 84, the lift harness 52 is sized to begin lifting the H-frame lift arm mechanism 18 which pivots about the second pair of pivot connections 44, 46 attached to the stern 20 of the host vessel 10.

Figure 4:
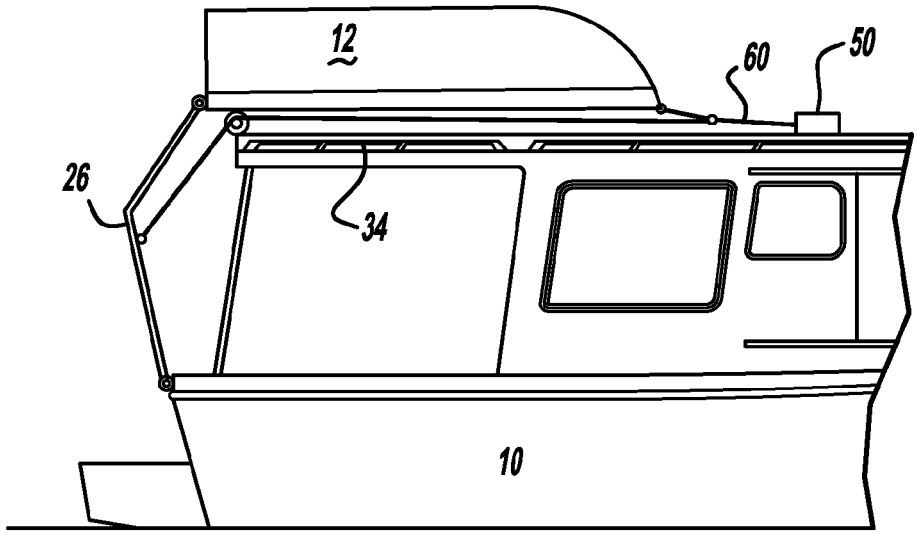
FIG. 4 is a partial side view of the small yacht tender fully raised to the top of the roof of the host vessel and H-frame lift arm mechanism fully pivoted in an upright position so that the swim platform may be used for its intended purposes.

FIG. 4 illustrates the tender 12 raised to its fully stowed position. In this position, a park securing strap (not shown) engages the tender 12 to ensure safe stowage during use of the host vessel 10. In fact, a park securing strap (not shown) is proposed if the tender 12 is only partially stowed on the roof or comparable suitable upright support structure.

In order to launch the tender 12 from its stowed position as shown in FIG. 4, it is first necessary to release the park securing strap that engages the tender 12. The electric winch 50 is then turned on and energized in the down direction while pressure is applied by an operator to manually begin to downward rotate the H-frame lift arm mechanism 18, which in turn begins to move the tender 12 along the rollers 80, 84 until gravity acting on the tender 12 acts on the winch cable 60 and the tender 12 begins to descend by rolling down the rollers 80, 84. The elongated H-shaped rigid lift arm members 22, 24 rotate counterclockwise about the second pair of pivot connections 44, 46 until the elongated H-shaped rigid lift arm members 22, 24 come to rest on the front edge of the swim platform 38. The outboard edge of the swim platform 38 is provided with a non-marring surface feature to protect the surface finish of the swim platform 38 from being blemished from the elongated H-shaped rigid lift arm members 22, 24 resting on the edge thereof. Alternatively, the bottom sides of the elongated H-shaped rigid lift arm members 22, 24 are provided with a non-marring surface feature. Further, small rubber standoff bumpers 86 maybe attached to the bottom side of the elongated H-shaped rigid lift arm members 22, 24 to rest on the swim platform 38. When the elongated H-shaped rigid lift arm members 22, 24 rest on the outboard edge of the swim platform 38 the tender's 12 bow 68 will be resting against the rollers 80, 84 and the electric winch 50 is paused while the tender 12 is pushed, by hand, standing on the deck of the host vessel 10 to initiate rotation down from vertical. In this position, the electrical winch 50 switch is then reenergized in the down direction to control the counterclockwise rotation of the tender 12 about the pivot connections 30, 32 until the winch cable 60 slackens with the tender 12 fully resting in the water. The lift harness 52 and winch cable 60 are then released from the bow 68 and elongated H-shaped rigid lift arm members 22, 24, and stored either in the tender 12 or host vessel 10. The electric winch 50 is then energized in the up direction to remove cable slack. The outboard motor 14 may now be installed on the tender 12 while the tender 12 is still latched to the elongated H-shaped rigid lift arm members 22, 24. This holds the tender 12 in a very stable fashion while the outboard motor 14 is installed. The outboard motor 12 can then be started before the pivot portion 78 of the quick release mechanism 74 is released to separate the tender 12 from the host vessel 10.

As described above, the towing arrangement solves the problems associated with prior art practices. The outboard motor and tender being completely out of the water eliminates drag on the host vessel when in motion at any speed. The use of a pair of horizontally spaced-apart lift arm members attached to both the stern of the host vessel as well as the transom 48 of the tender provides stability in supporting the tender 12 when the outboard motor is removed and passengers are loaded into or unloaded from the tender 12. Since the small yacht tender is stored on top of the roof or other suitable support structure in an upside-down position there is no need to provide a cover for the small yacht tender while the host vessel is docked.

While the present invention has been described in terms of a preferred embodiment, it is apparent that other forms may be adopted by one skilled in the art. In other words, claim elements are not limited to the imperfection of the exact language used, but encompass as well other structures that fulfill the same functional purpose. For example, the electric winch may be mounted to the underside of the roof so that direct control, without a wireless control, is possible providing the appropriate support necessary to route the winch cable to the same upper position that is used with a top of roof mount winch, is provided. Those skilled in the art will appreciate that other applications are possible with this invention. Accordingly, the present invention is not limited to the preferred embodiment disclosed. Therefore, the scope of the present invention is to be limited only by the following claims.

What is claimed is:

1. An apparatus for the stowing and retrieving of a small craft with a support structure of a host vessel, said apparatus comprising:

a pair of elongated rigid lift arm members, each arm of said pair of elongated rigid lift arm members having one end and an opposite end;

a pair of pivot connections for coupling said one end of each arm of said pair of elongated rigid lift arm members to the stern of said host vessel;

a second pair of pivot connections for releasably coupling said opposite end of each arm of said pair of elongated rigid lift arm members to the stern of said small craft;

a lift harness for attaching at one end to the bow of said small yacht craft and having a bifurcated opposite end, each branch of said bifurcated opposite end for attaching to a respective one of said pair of elongated rigid lift arm members;

a cross brace attached at each end to a respective arm of said pair of elongated rigid lift arm members, said cross brace coupling said pair of elongated rigid lift arm members such that each of said arms of said pair of elongated rigid lift arm members pivot concurrently as a single frame unit;

a lift apparatus for attachment to said small yacht craft to pivot said small yacht craft about said second pair of pivot connections to raise said small yacht craft out of the water and rest said bow thereof against said support structure of said host vessel, said lift apparatus further lifting said small yacht craft and simultaneously pivoting said pair of elongated rigid lift arm members about said pair of pivot connections mounted to said stern of said host vessel whereby said small yacht craft is at least partially mounted on said support structure and said pair of elongated rigid lift arm members have pivoted to a position substantially parallel to said stern of said host vessel; and a securing strap to be mounted to said support structure to secure said small yacht craft to said support structure when said small yacht craft is at least partially stored on said support structure.

2. The apparatus as claimed in claim 1 wherein said lift apparatus further comprises:

force generating apparatus applied to said single frame unit to initiate pivotal movement, in a counter-clockwise direction, of said pair of elongated rigid lift arm members while concurrently moving said small yacht craft towards said stern of said host vessel;

a power winch mounted on said host vessel in proximity to the bow of said small yacht craft when said small yacht craft is fully mounted on said support structure;

a winch cable having one end attached to the power winch and an opposite end attached to said lift harness near said bow of said small yacht craft to support said small yacht craft while said small yacht craft descends from said support structure as said pair of elongated rigid lift arm members rotate counter-clockwise to a lowered position whereby said small yacht craft rests against a roller assembly attached to said support structure of said host vessel.

3. The apparatus as claimed in claim 2 further comprises:

said roller assembly mounted to a stern edge of said support structure, said roller assembly further comprising a pulley roller centrally mounted to said support structure for receiving said winch cable and maintaining said winch cable on said roller during stowage and launching of said small yacht craft; and a pair of support rollers straddling said pulley roller, each support roller of said pair of support rollers mounted to said stern edge of said support structure, each of said support rollers respectively receiving a side of said small yacht craft to support said small yacht craft (tubes in the case of an inflatable tender, gunnels in case of a rigid tender) as they proceed past said support rollers during stowage and launching of said small yacht craft.

4. The apparatus as claimed in claim 1 further comprising a swim platform mounted to said stern of said host vessel.

5. The apparatus as claimed in claim 4 further comprising a protective non-marring surface applied to the stern edge of said swim platform so as to protect said swim platform when said elongated rigid lift arm members are resting on the edge of said swim platform when said small yacht craft is lowered in the launching position.

6. The apparatus as claimed in claim 2 further comprising a remote control apparatus mounted to said power winch to operate said power winch from a remote location from said host vessel.

7. The apparatus as claimed in claim 4 further comprising a plurality of protective resilient bumpers mounted to the underside of each elongated rigid lift arm member of said pair of elongated rigid lift arm members such that said plurality of protective resilient bumpers communicate with said swim platform when said single frame unit is in its lowest position.

8. The apparatus as claimed in claim 7 further comprising a protective non-marring surface applied to the stern edge of said swim platform so as to protect said swim platform when said resilient bumpers attached to said elongated rigid lift arm members are resting on the edge of said swim platform when said small yacht craft is lowered in the launching position.

9. A method of stowing a small craft on a support structure of a host vessel, said method comprising the steps of:

orienting the stern of said small yacht craft to face the stern of said host vessel in a fully-floating orientation in which both the stern and bow of said small yacht craft float in water behind said host vessel;

coupling one end of a pair of rigid lift arm members to a pivot connection mounted to said stern of said host vessel;

releasably coupling an opposite end of said pair of rigid lift arm members to a second pivot connection secured to the transom of said small yacht craft;

displacing said small yacht craft from said fully floating orientation to an intermediate orientation in which both said bow and said stern of said small yacht craft is clear of the water and the bow of said small yacht craft is resting against said support structure on said host vessel lifting the bow of said small yacht craft out of the water by using an electric winch and lift cable mounted on said support structure of said host vessel and rotating said small yacht craft about said second pivot connection secured to said stern of said small yacht craft.

10. The method as claimed in claim 9 further comprising the step of continue displacing said small yacht craft by lifting said small yacht craft from said intermediate orientation to a final storage substantially horizontal orientation on top of said support structure of said host vessel in which said electric winch and lift cable mounted on said support structure of said host vessel continues to lift said small yacht craft unto to top of said support structure while simultaneously pivoting an opposite end of said pair of rigid lift arm members about said pivot connection mounted on said stern of said host vessel; securing said small yacht craft to said support structure in said final storage orientation.

* * * * *